US011530569B2

(12) United States Patent
Stenlund

(10) Patent No.: US 11,530,569 B2
(45) Date of Patent: Dec. 20, 2022

(54) DRILL PROTECTION DEVICE, DRILL PROTECTION ASSEMBLY AND ACCESS MEMBER

(71) Applicant: ASSA ABLOY AB, Stockholm (SE)

(72) Inventor: Peter Stenlund, Stockholm (SE)

(73) Assignee: ASSA ABLOY AB, Stockholm (SE)

( * ) Notice: Subject to any disclaimer, the term of this patent is extended or adjusted under 35 U.S.C. 154(b) by 375 days.

(21) Appl. No.: 16/756,750

(22) PCT Filed: Oct. 1, 2018

(86) PCT No.: PCT/EP2018/076643
§ 371 (c)(1),
(2) Date: Apr. 16, 2020

(87) PCT Pub. No.: WO2019/081163
PCT Pub. Date: May 2, 2019

(65) Prior Publication Data

US 2021/0189790 A1 Jun. 24, 2021

(30) Foreign Application Priority Data

Oct. 24, 2017 (EP) ..... 17197996

(51) Int. Cl.
*E05G 1/024* (2006.01)
*E06B 5/11* (2006.01)

(52) U.S. Cl.
CPC ..... *E05G 1/024* (2013.01); *E06B 5/11* (2013.01)

(58) Field of Classification Search
CPC ..... E05G 1/024; E06B 5/11
See application file for complete search history.

(56) References Cited

U.S. PATENT DOCUMENTS 4,509,350 A 4/1985 Gartner
6,363,867 B1 * 4/2002 Tsilevich ..... E05G 1/024 109/81
8,991,118 B2 * 3/2015 Tunis, III ..... F41H 5/226 52/203

(Continued)

FOREIGN PATENT DOCUMENTS

CN 201074456 6/2008
CN 201100063 8/2008

(Continued)

OTHER PUBLICATIONS

EPO communications regarding intention and decision to grant a patent in corresponding Application No. 17197996.6 (33 pages). (Year: 2019).*

(Continued)

*Primary Examiner* — Rodney Mintz
(74) *Attorney, Agent, or Firm* — Sheridan Ross P.C.

(57) ABSTRACT

Drill protection device (12) for an access member (10), the drill protection device (12) comprising an enclosure (26) defining an interior volume (50) and comprising a first side wall (32); at least one rigid first plate member (40) arranged within the interior volume (50), the at least one first plate member (40) being flexibly connected to the first side wall (32) and angled with respect to the first side wall (32); and fibers (52) arranged within the interior volume (50). A drill protection assembly (68) and an access member (10) are also provided.

14 Claims, 7 Drawing Sheets

(56) References Cited

U.S. PATENT DOCUMENTS

| | | | | |
|---|---|---|---|---|
| 9,316,467 | B2 * | 4/2016 | Tunis, III | F41H 5/0471 |
| 9,333,714 | B2 * | 5/2016 | Tunis, III | B43L 1/00 |
| 10,378,267 | B2 * | 8/2019 | Grant | B32B 5/024 |
| 2014/0261108 | A1 * | 9/2014 | Tunis, III | E05G 1/026 434/408 |
| 2015/0143986 | A1 * | 5/2015 | Tunis, III | B43L 1/008 156/60 |
| 2015/0268009 | A1 * | 9/2015 | Tunis, III | F41H 5/013 89/36.02 |
| 2018/0347255 | A1 * | 12/2018 | Grant | E05G 1/024 |

FOREIGN PATENT DOCUMENTS

| | | |
|---|---|---|
| CN | 201412043 | 2/2010 |
| CN | 103498617 | 1/2014 |
| CN | 105793020 | 7/2016 |
| CN | 106068210 | 11/2016 |
| FR | 2590619 | 5/1987 |
| GB | 1451046 | 9/1976 |

OTHER PUBLICATIONS

Official Action with English Translation for China Patent Application No. 201880068826.8, dated Apr. 7, 2021, 16 pages.

International Search Report and Written Opinion for International (PCT) Patent Application No. PCT/EP2018/076643, dated Oct. 23, 2018, 11 pages.

Official Action with English Translation for China Patent Application No. 201880068826.8, dated Sep. 26, 2021, 12 pages.

Official Action with English Translation for China Patent Application No. 201880068826.8, dated Dec. 24, 2021, 18 pages.

Official Action with Partial English Translation for China Patent Application No. 201880068826.8, dated Apr. 1, 2022, 9 pages.

Official Action with English Translation for China Patent Application No. 201880068826.8, dated Aug. 24, 2022, 7 pages.

* cited by examiner

DRILL PROTECTION DEVICE, DRILL PROTECTION ASSEMBLY AND ACCESS MEMBER

CROSS REFERENCE TO RELATED APPLICATIONS

This application is a national stage application under 35 U.S.C. 371 and claims the benefit of PCT Application No. PCT/EP2018/076643 having an international filing date of 01 Oct. 2018, which designated the United States, which PCT application claimed the benefit of European Patent Application No. 17197996.6 filed 24 Oct. 2017, the disclosure of each of which are incorporated herein by reference.

TECHNICAL FIELD

The present disclosure generally relates to drill protection devices. In particular, a drill protection device, a drill protection assembly comprising at least two drill protection devices, and an access member comprising a drill protection device or a drill protection assembly, are provided.

BACKGROUND

Securing buildings and vehicles from unlawful intrusion by thieves has been a challenge for decades. Not least the distribution industry suffers from burglary. A common way for thieves to break into vehicles is by drilling a hole in a door of the vehicle. Once the door has been drilled through, the thief can insert an object to manipulate the lock to unlock the lock and open the door. The time from initiating drilling to unlocking the door is often less than 30 seconds. These types of attacks lead to high reparation costs, costs due to lost goods, downtime of the vehicles, delays etc.

U.S. Pat. No. 4,509,350 A describes a protective lock mounting plate provided between a lock housing on the interior of a safe door and the interior surface of the safe door to resist drilling into the lock housing through the door in areas adjacent a combination dial, or the like, on the exterior of the safe door in a frontal location relative lock works within the lock housing. Non-drillable material is positioned in annular rings bonded in grooves of concentric circular configuration formed in a surface of the mounting plate which is directed against the interior surface of the door facing in the direction from which drilling intrusion is anticipated.

SUMMARY

One object of the present disclosure is to provide a drill protection device that efficiently opposes drilling.

A further object of the present disclosure is to provide a cheap drill protection device.

A still further object of the present disclosure is to provide a simple drill protection device.

A still further object of the present disclosure is to provide a drill protection device that can be retro-fitted to an access member, such as a door wing.

A still further object of the present disclosure is to provide a drill protection device that can easily be attached to an access member.

A still further object of the present disclosure is to provide a drill protection assembly solving one or more of the foregoing objects.

A still further object of the present disclosure is to provide an access member solving one or more of the foregoing objects.

According to one aspect, there is provided a drill protection device for an access member. The drill protection device comprises an enclosure defining an interior volume and comprising a first side wall; at least one first plate member arranged within the interior volume, the at least one first plate member being flexibly connected to the first side wall and angled with respect to the first side wall; and fibers arranged within the interior volume, such as randomly arranged within the interior volume. Each of the at least one first plate member may be rigid. Thus, if the first plate member is subjected to a force, the first plate member deflects relative to the first side wall.

A drill protection device according to the present disclosure may be mounted to any type of access member or door wing in order to prevent unlawful entry therethrough. For example, the drill protection device may be mounted to doors of vehicles, such as cars, vans, security vans, service vehicles, trucks, buses etc. As further examples, the drill protection device may also be mounted to doors of residences, warehouses, industrial buildings, etc.

Continuous fibers and/or woven structures of one or more fabrics comprising fibers can be arranged within the interior volume. The fibers may be enclosed in a bag or package within the interior volume. The fibers may fill a part of the interior volume or may fill substantially the entire interior volume, such as filling the entire interior volume.

The fibers according to the present disclosure may be of the same type or similar to the fibers used in cut-retardant material. One type of cut-retardant material is the type used in protective clothing that provides protection for power tools, such as chainsaws.

The fibers according to the present disclosure may thus have a high strength. The fibers may consist of polymers having high molecular weights, such as ultrahigh molecular weights, i.e. polymers having a molecular mass between 3.5 and 7.5 million unified atomic mass unit, u. The fibers may have a low linear density, such as a linear density of 1 to 3 dpf (denier per filament, the mass in grams per 9000 meters of the fiber).

The fibers may at least partially be produced from, or at least partially comprise, bamboo, Dyneema® fiber, glass, hemp, high-strength polyester, polyamides, such as aramids, polyethylene, such as linear polyethylene, Kevlar® fiber, polyamide, or Spectra® fiber.

The at least one first plate member may be angled 35 degrees to 85 degrees, such as 45 degrees to 75 degrees, such as 55 degrees to 65 degrees, such as approximately 60 degrees, with respect to a normal of the first side wall.

In case the drill protection device comprises a plurality of first plate members angled with respect to a normal of the first side wall, the first plate members may be arranged parallel to each other. Alternatively, or in addition, the first plate members may be arranged to overlap each other. That is, two or more first plate members may intersect a normal of the first side wall. Within the outermost first plate members, no normal of the first side wall may pass between two first plate members when the first plate members adopt their neutral undeflected states.

The drill protection device may further comprise a first flange associated with each of the at least one first plate member. In this case, the first flange may be provided on the first side wall and configured to flexibly support an associated first plate member of the at least one first plate member. The at least one first flange may be integrally formed with the first side wall. Other means for flexibly supporting the first plate members relative to the first side wall are however conceivable.

The enclosure may be made of sheet metal, such as stainless steel or hardened steel. Alternatively, the enclosure may be made of a composite material, such as a fiber-reinforced plastic, such as fiber-reinforced polyamide. Such enclosure may be injection molded, e.g. in two sections that are subsequently attached. According to one example, the composite material is constituted by matrix material and at least 50% fibers. Alternatively, the enclosure may be made of whiskers (single crystals of silicon carbide, silicone nitride, sapphire, etc.) and/or ceramics.

The enclosure may have a substantially flat appearance, such as a flat appearance. The enclosure may have a thickness of approximately 3 to 20 mm, such as approximately 5 mm.

The enclosure may comprise a second side wall, opposite to the first side wall, and the drill protection device may further comprise at least one second plate member arranged within the interior volume, the at least one second plate member being flexibly connected to the second side wall and angled with respect to the second side wall. Each of the at least one second plate member may be rigid. Thus, if the second plate member is subjected to a force, the second plate member deflects relative to the second side wall.

The at least one second plate member may be angled 35 degrees to 85 degrees, such as 45 degrees to 75 degrees, such as 55 degrees to 65 degrees, such as approximately 60 degrees, with respect to a normal of the second side wall.

In case the drill protection device comprises a plurality of second plate members angled with respect to a normal of the second side wall, the second plate members may be arranged parallel to each other. Alternatively, or in addition, the second plate members may be arranged to overlap each other. That is, two or more second plate members may intersect a normal of the second side wall. Within the outermost second plate members, no normal of the second side wall may pass between two second plate members when the second plate members adopt their neutral undeflected states.

The second plate members may be aligned with the first plate members, e.g. at the same height along a direction parallel with the normal of the first side wall and a normal of the second side wall. Alternatively, the second plate members may be offset with respect to the first plate members. As a further alternative, the second plate members may be distributed independently of the first plate members.

Each of the first plate members may be of the same size and/or each of the second plate members may be of the same size. Alternatively, the first plate members may be of a different size than the second plate members.

The drill protection device may further comprise a second flange associated with each of the at least one second plate member. In this case, the second flange may be provided on the second side wall and configured to flexibly support an associated second plate member of the at least one second plate member. The at least one second flange may be integrally formed with the second side wall. Other means for flexibly supporting the second plate members relative to the second side wall are however conceivable.

Throughout the present disclosure, a first side wall, a first plate member and a first flange may alternatively be referred to as an outer side wall, an outer plate member and an outer flange, respectively. Thus, the outer side wall of the drill protection device is intended to be the exterior-most side wall of the drill protection device, e.g. attached to the interior surface of an exterior plate of an access member. Correspondingly, a second side wall, a second plate member and a second flange may alternatively be referred to as an inner side wall, an inner plate member and an inner flange, respectively.

The drill protection device according to the present disclosure may comprise a plurality of first plate members and a plurality of second plate members according to the present disclosure. According to one variant, the drill protection device comprises at least one first plate member according to the present disclosure but no second plate members. When the drill protection device comprises at least one first plate member and at least one second plate member according to the present disclosure, a plurality of flexible layers are provided, e.g. an outer layer provided by the outer plate members and an inner layer provided by the inner plate members.

Each plate member may be made of sheet metal, such as stainless steel. Alternatively, each plate member may be made of ceramics or a composite material. In any case, each plate member may have a thickness of 1 mm to 3 mm, such as approximately 2 mm.

Each flange may have a thickness of 0.5 mm to 1.5 mm, such as approximately 0.8 mm. In any case, each flange may be weaker than the plate member supported by the flange. This may be accomplished by a reduced thickness of the flange and/or the provision of a flange of a weaker material than the material of the associated plate member. The flanges may have the same thickness as, and/or be integrally formed with, the enclosure. The flanges may be made of steel.

The drill protection device may further comprise an accelerometer configured to detect vibrations in the drill protection device. The accelerometer may be constituted by a three-axis accelerometer. The accelerometer may be in signal communication with a central control unit, e.g. a vehicle control unit or a remote control unit. The signal communication may be wireless. If unexpected vibrations are detected in the drill protection device by means of the accelerometer, an alarm system may be activated, e.g. an alarm message to a remote control center or similar may be sent for further action.

According to a further aspect, there is provided a drill protection assembly for an access member. The drill protection assembly may comprise at least two drill protection devices according to the present disclosure. A drill protection device according to the present disclosure may alternatively be referred to as a drill protection module. Thus, one or several drill protection modules, of the same or different size, may be attached to an access member to provide a custom fit to the access member.

The drill protection devices may be arranged in a stack. The stack may be prepared before attaching the drill protection assembly to the access member. Alternatively, several drill protection devices may be attached one by one to an access member to form a stack on the access member. The drill protection devices may for example be attached by double-sided tape or glue.

According to a further aspect, there is provided an access member comprising a drill protection device according to the present disclosure or a drill protection assembly according to the present disclosure.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein. Rather, these embodiments are provided by way of example so that this disclosure will be thorough and complete, and will fully convey the scope of the invention to those skilled in the art. Like numbers refer to like elements throughout the description.

Figure 1:
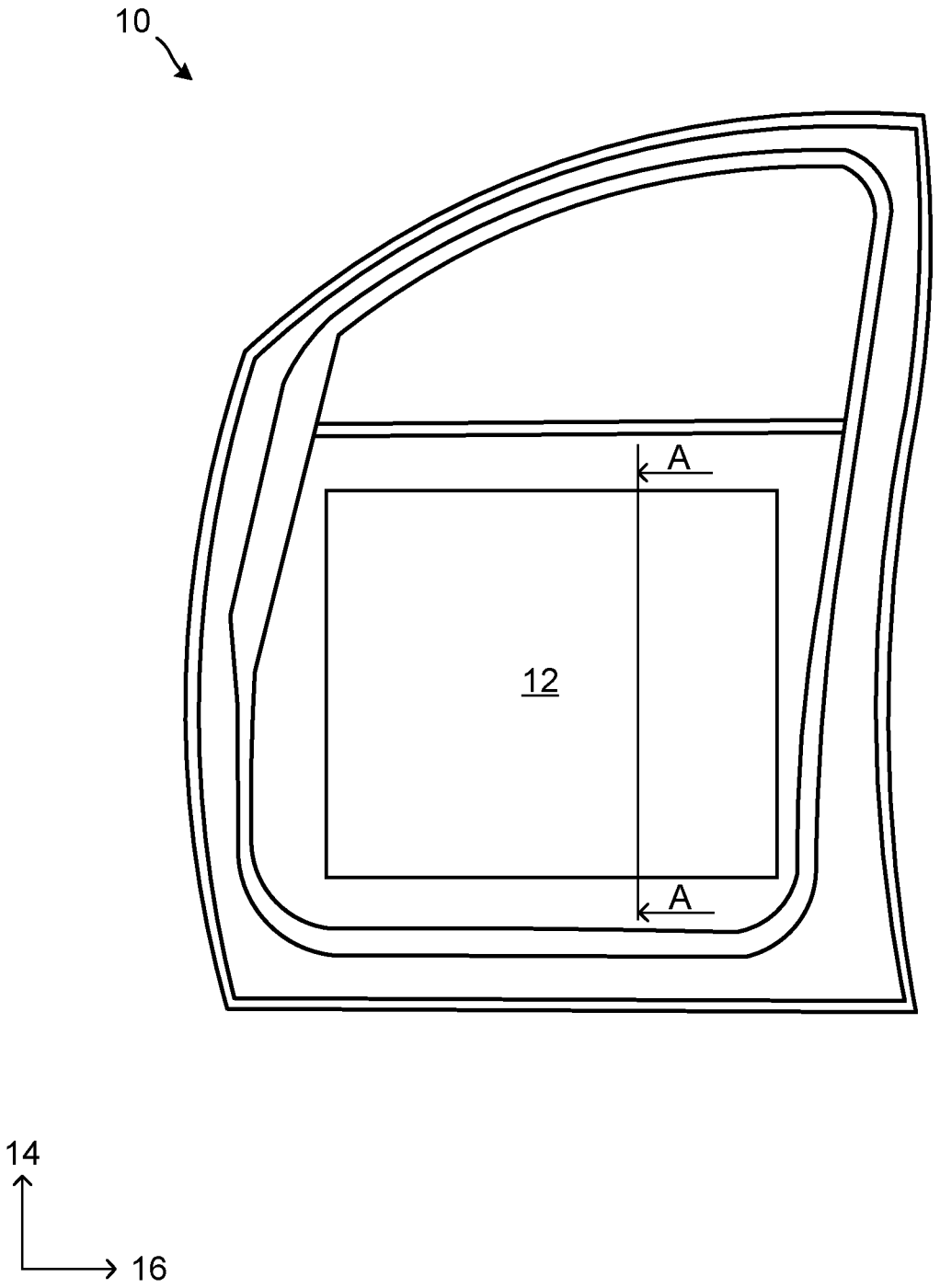
FIG. 1: schematically represents an inner view of an access member comprising a drill protection device.

FIG. 1 schematically represents an inner view of an access member 10 comprising a drill protection device 12. The access member 10 is here exemplified as a vehicle door. The drill protection device 12 is attached to the interior side of the access member 10. FIG. 1 further indicates a vertical direction 14 and a first horizontal direction 16.

Figure 2:
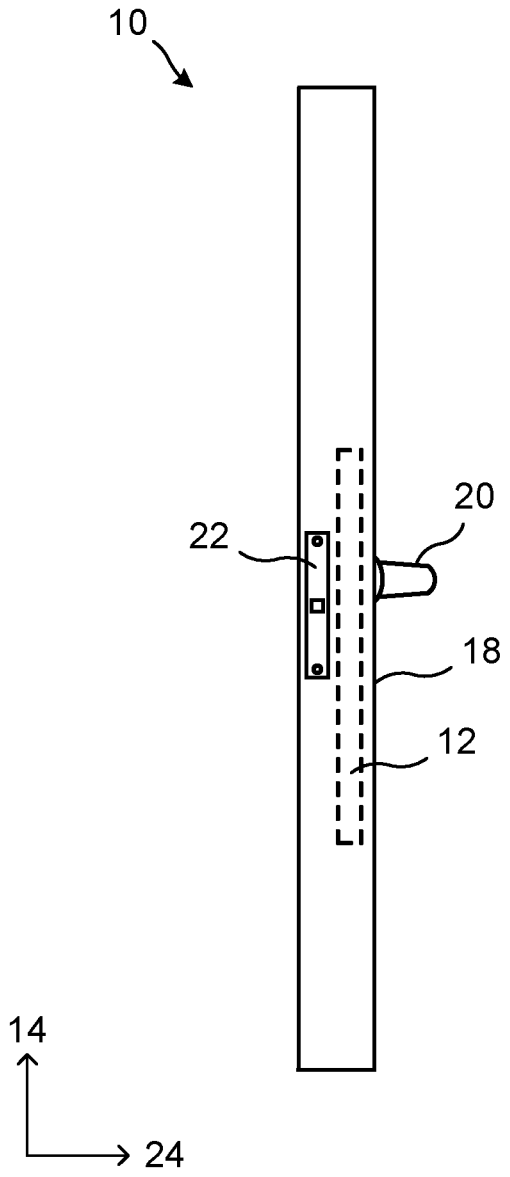
FIG. 2: schematically represents a side view of the access member and the drill protection device.

FIG. 2 schematically represents a side view of the access member 10 and the drill protection device 12 in FIG. 1. The access member 10 comprises an exterior plate 18. The drill protection device 12 is attached to the inside of the exterior plate 18. In FIG. 2, a handle 20 and a lock case 22 of the access member 10 can also be seen. FIG. 2 further indicates a second horizontal direction 24, perpendicular to the first horizontal direction 16.

Figure 3:
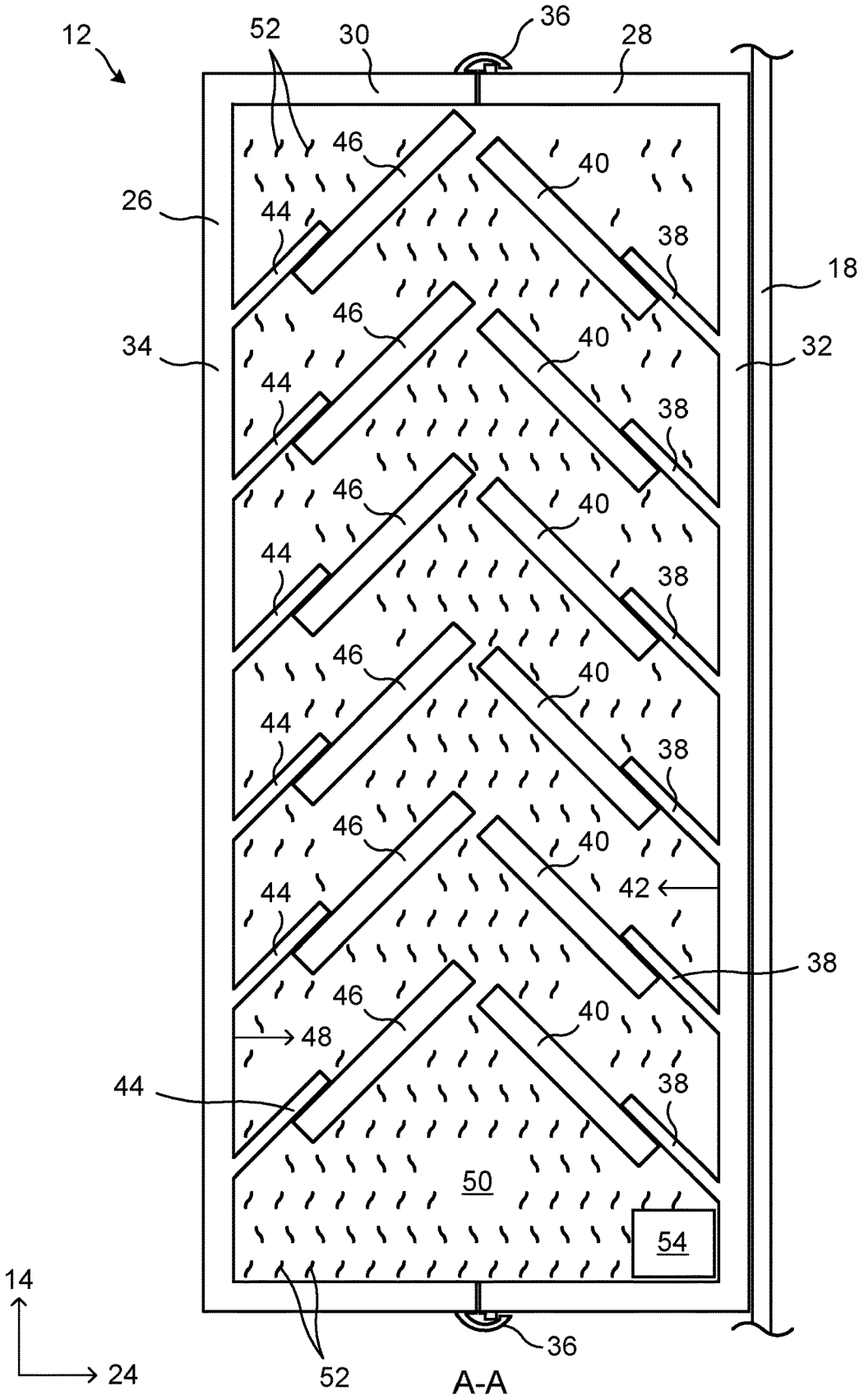
FIG. 3: schematically represents a cross sectional view along line A-A in FIG. 1.

FIG. 3 schematically represents a cross sectional view along line A-A in FIG. 1 and shows details of one example of a drill protection device 12 according to the present disclosure. The drill protection device 12 comprises an enclosure 26. The drill protection device 12 is attached to the exterior plate 18. The attachment (not shown) may for example be made by means of double-sided tape, glue or by screw's. In case a screw connection is employed, one or more brackets (not illustrated) may be provided on the enclosure 26 such that screws can be attached to the access member 10 without screwing into the exterior plate 18, e.g. screwed parallel to the exterior plate 18.

The enclosure 26 of this example comprises an outer or first section 28 and an inner or second section 30. Each of the first section 28 and the second section 30 of this example are made of sheet metal of stainless steel. The enclosure 26 may alternatively be injection molded by a composite material. The thickness of the first section 28 and the second section 30 may for example be 2 mm.

The first section 28 of the enclosure 26 comprises a first side wall 32 and the second section 30 of the enclosure 26 comprises a second side wall 34. The first section 28 and the second section 30 are connected by snap-fit connections 36. The first section 28 and the second section 30 may however alternatively be connected by other or additional means, such as screws, glue etc.

The dimensions of the enclosure 26 in FIG. 3 are somewhat exaggerated. In particular, the enclosure 26 may have a flatter appearance than illustrated in FIG. 3. The enclosure 26 may for example have a thickness (in the second horizontal direction 24 in FIG. 3) of approximately 5 mm. The enclosure 26 may be manufactured in various different dimensions. The enclosure 26 may for example have a width of 300 mm, a height of 300 mm and a thickness of 5 mm.

The drill protection device 12 further comprises a plurality of (six in FIG. 3) outer or first flanges 38. In this example, the first flanges 38 are also made of sheet metal of stainless steel having a thickness of 0.8 mm.

The drill protection device 12 further comprises a plurality (six in FIG. 3) of outer or first plate members 40. One first plate member 40 is associated with each first flange 38. In this example, each of the first plate member 40 is made of sheet metal of stainless steel having a thickness of 2.0 mm. Each first plate member 40 is attached to an associated first flange 38, for example by screws or glue. Each first plate member 40 extends along the entire width (the direction perpendicular to the paper in FIG. 3) of the enclosure 26.

In this example, each of the first plate members 40 is angled approximately 45 degrees with respect to a normal 42 of the first side wall 32. However, the angles of the first plate members 40 may vary. The first plate members 40 of this example are parallel but non-parallel orientations of the first plate members 40 are possible.

The drill protection device 12 further comprises a plurality of (six in FIG. 3) inner or second flanges 44. In this example, the second flanges 44 are also made of sheet metal of stainless steel having a thickness of 0.8 mm.

The drill protection device 12 further comprises a plurality of (six in FIG. 3) inner or second plate members 46. One second plate member 46 is associated with each second flange 44. In this example, each of the second plate member 46 is made of sheet metal of stainless steel having a thickness of 2.0 mm. Each second plate member 46 is attached to an associated second flange 44, for example by screws or glue. Each second plate member 46 extends along the entire width (the direction perpendicular to the paper in FIG. 3) of the enclosure 26.

In this example, each of the second plate members 46 is angled approximately 45 degrees with respect to a normal 48 of the second side wall 34. Thus, in this example, the second plate members 46 are substantially perpendicular to the first plate members 40. However, also the angles of the second plate members 46 may vary. The second plate members 46 of this example are parallel but non-parallel orientations of the second plate members 46 are possible.

The enclosure 26 defines an interior volume 50. In this example, the enclosure 26 and the interior volume 50 is of rectangular appearance. However, alternative shapes of the enclosure 26 and/or of the interior volume 50 are conceivable.

The drill protection device 12 further comprises fibers 52 arranged within the interior volume 50 of the enclosure 26. In the example in FIG. 3, the fibers 52 are randomly arranged within the interior volume 52, but the fibers 52 may alternatively be oriented. The fibers 59 are packed within the interior volume 50 and fill substantially the entire interior volume 50. The fibers 52 may be of the same type or similar to the fibers used in cut-retardant material. The fibers 52 may for example comprise, bamboo, Dyneema® fiber, glass, hemp, high-strength polyester, polyamides, such as aramids, polyethylene, such as linear polyethylene, Kevlar® fiber, polyamide, Spectra® fiber, or combinations thereof.

The drill protection device 12 further comprises an accelerometer 54. The accelerometer 54 is configured to detect vibrations in the drill protection device 12. In the example of FIG. 3, the accelerometer 54 is arranged inside the enclosure 26. The accelerometer 54 may be configured to be in signal communication with a central control unit (not shown) in order to notify an owner and/or activate an alarm system if the vibrations detected by the accelerometer 54 indicate that a drilling operation has been initiated on the drill protection device 12. The accelerometer 54 may be substantially centered within the drill protection device 12 along the first horizontal direction 16.

Figure 4:
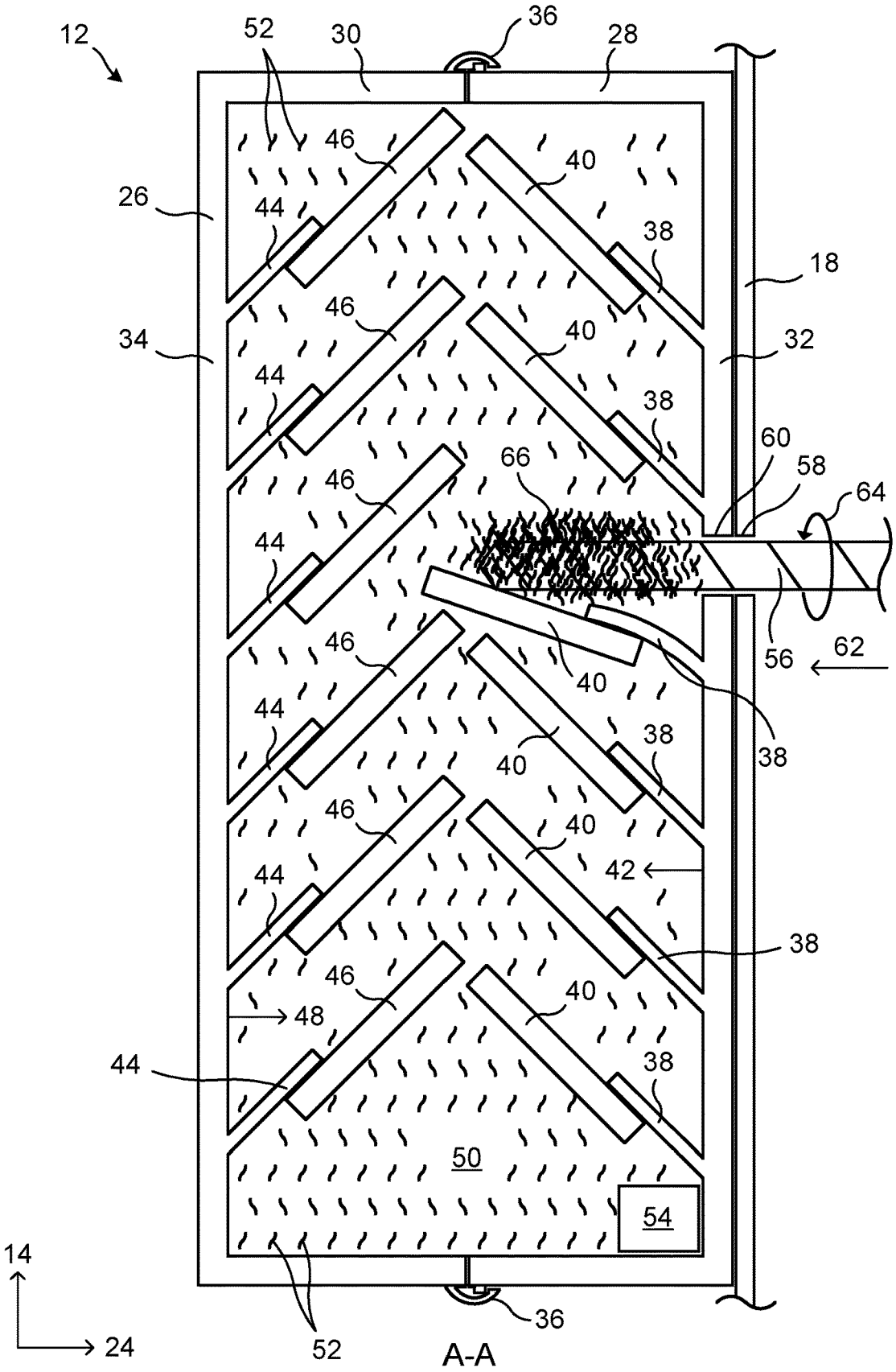
FIGS. 4 and 5: schematically represent a drilling operation into the drill protection device in FIG. 3.
Figure 5:
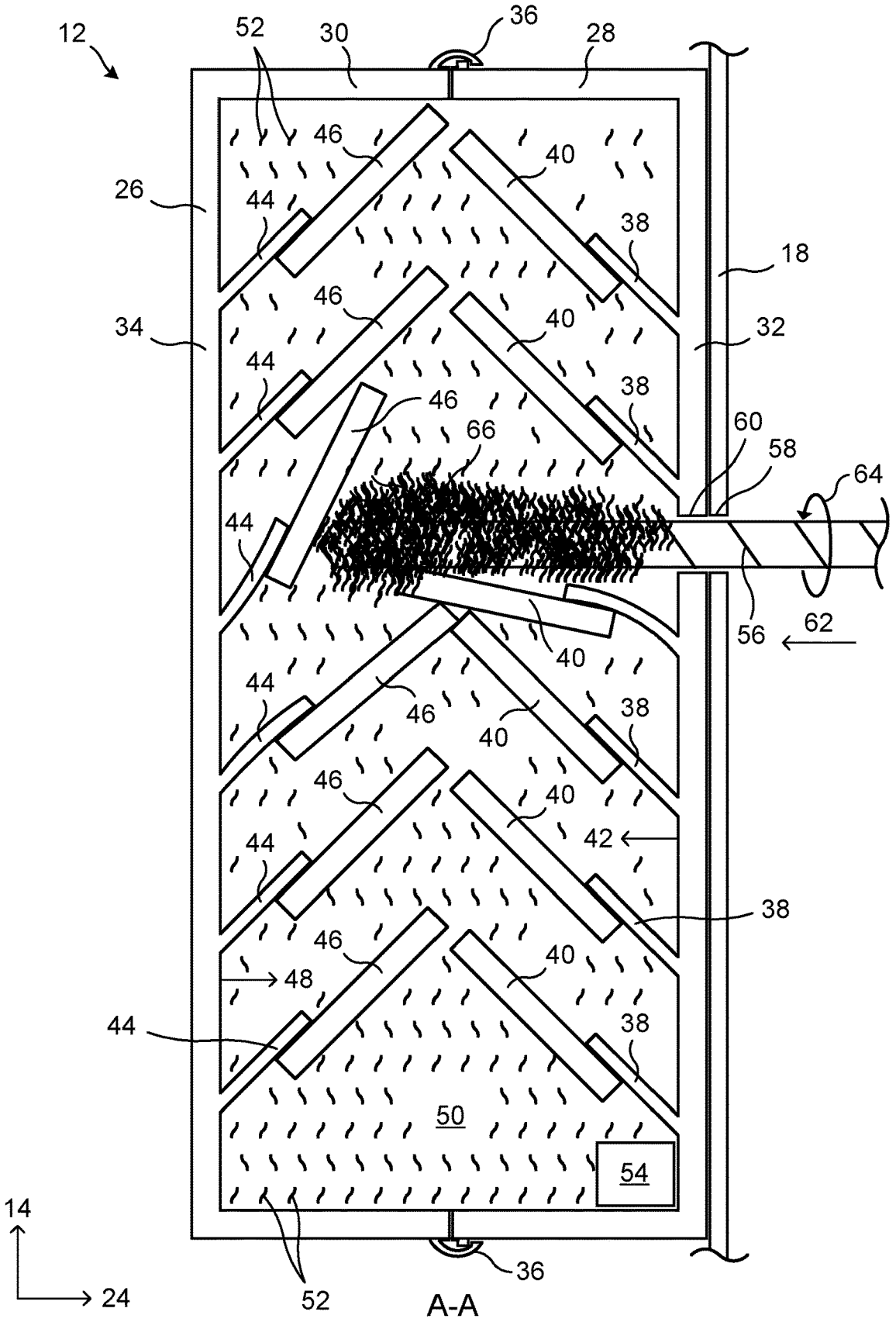

FIGS. 4 and 5 schematically represent a drilling operation with a drill bit 56 into the drill protection device 12 in FIG. 3. With reference to FIG. 4, when a thief drills an entry hole 58 through the exterior plate 18, for example by using a cordless drill, and an entry hole 60 through the first side wall 32 of the drill protection device 12, the drill bit 56 proceeds into the interior volume 50. In FIG. 4, the drilling direction is indicated by arrow 62 and the rotational direction of the drill bit 56 is indicated by arrow 64.

As the drilling continues, the drill bit 56 hits one of the first plate members 40 which consequently deflects by the force applied to the drill bit 56. The first plate member 40 deflects due to the flexible connection to the first side wall 32, which in this example is implemented by the first flange 38. Since the first flange 38 is weaker than the first plate member 40, first flange 38 functions as a hinge about which the first plate member 40 rotates.

As the drill bit 56 rotates within the interior volume 50, the fibers 52 are rapidly wound up on the drill hit 56. A fiber bundle 66 is thereby generated on the drill bit 56 and the cutting capacity of the drill bit 56 is impaired. Particularly fibers 52 that are oriented perpendicular to the drill bit 56 accumulate in the spiral of the drill bit 56.

The size of the fiber bundle 66 grows rapidly as the drill bit 56 rotates, the faster the rotational speed of the drill bit 56 and the larger the diameter of the fiber bundle 66 is (high peripheral speed), the faster the fiber bundle 66 grows. Once the size of the fiber bundle 66 exceeds the size of the entry holes 58, 60, withdrawal of the drill bit 56 out from the enclosure 26 is prevented.

The deflection of the first plate member 40 also prevents the drill bit 56 from drilling through the first plate member 40. As a consequence, the fibers 52 become more and more packed in the spiral of the drill bit 56 and the drill bit 56 rapidly loses cutting capacity.

As illustrated in FIG. 5, if the drill bit 56 is pushed further in the drilling direction 62, the drill bit 56 reaches beyond the first plate member 40 and contacts one of the second plate members 46. Also the second plate member 46 deflects when being pushed by the drill bit 56. At this point, the fiber bundle 66 on the drill bit 56 has become even larger. The eliminated (or highly reduced) cutting capacity of the drill bit 56 (due to the fibers 52 accumulated in the spiral of the drill bit 56) together with the deflection of the second plate member 46 makes it at least very difficult to drill through the enclosure 26. If the drill bit 56 is pushed further in the drilling direction 62, the drill bit 56 breaks.

If the drill bit 56 is broken or if the drill bit 56 cannot be retracted out from the drill protection device 12, the thief has to attach a new drill bit 56 to the drill and start the drilling operation anew. This adds valuable time to the burglary attempt.

Although a burglary attempt by using a drill has been described, the drill protection device 12 according to the present disclosure also functions for burglary attempts by using similar mechanical tools, such as an angle grinder.

Figure 6:
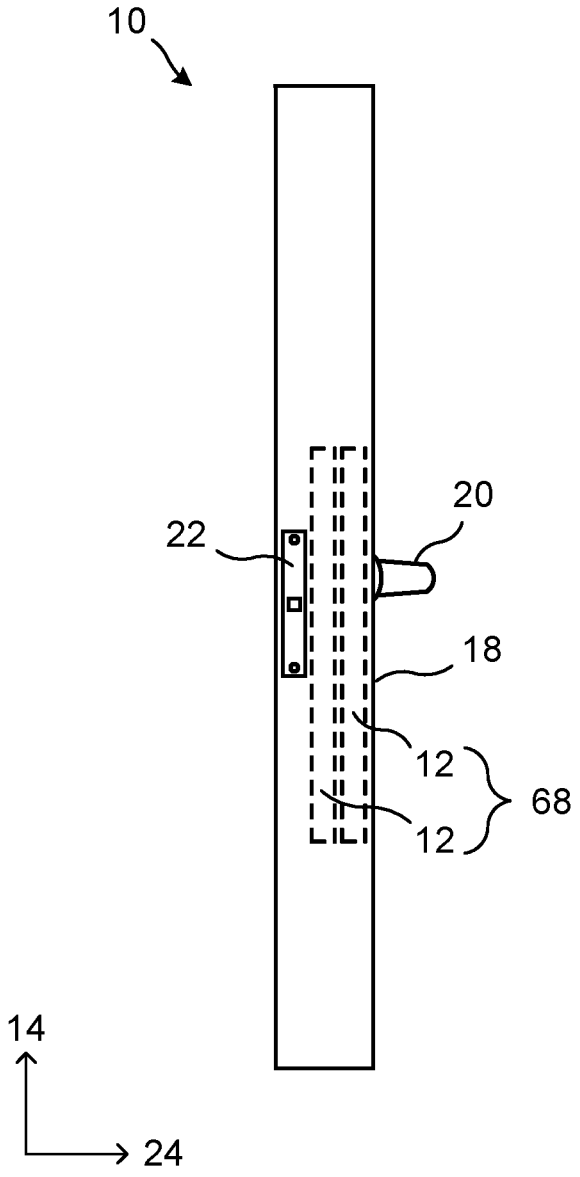
FIG. 6: schematically represents a side view of an access member comprising a drill protection assembly.

FIG. 6 schematically represents a side view of an access member 10 comprising a drill protection assembly 68. In the unlikely event that drilling through a first drill protection device 12 succeeds, one or more further drill protection devices 12 may be attached to the first drill protection device 12. In this manner, the time required to drill through the drill protection assembly 68 is further increased.

Figure 7:
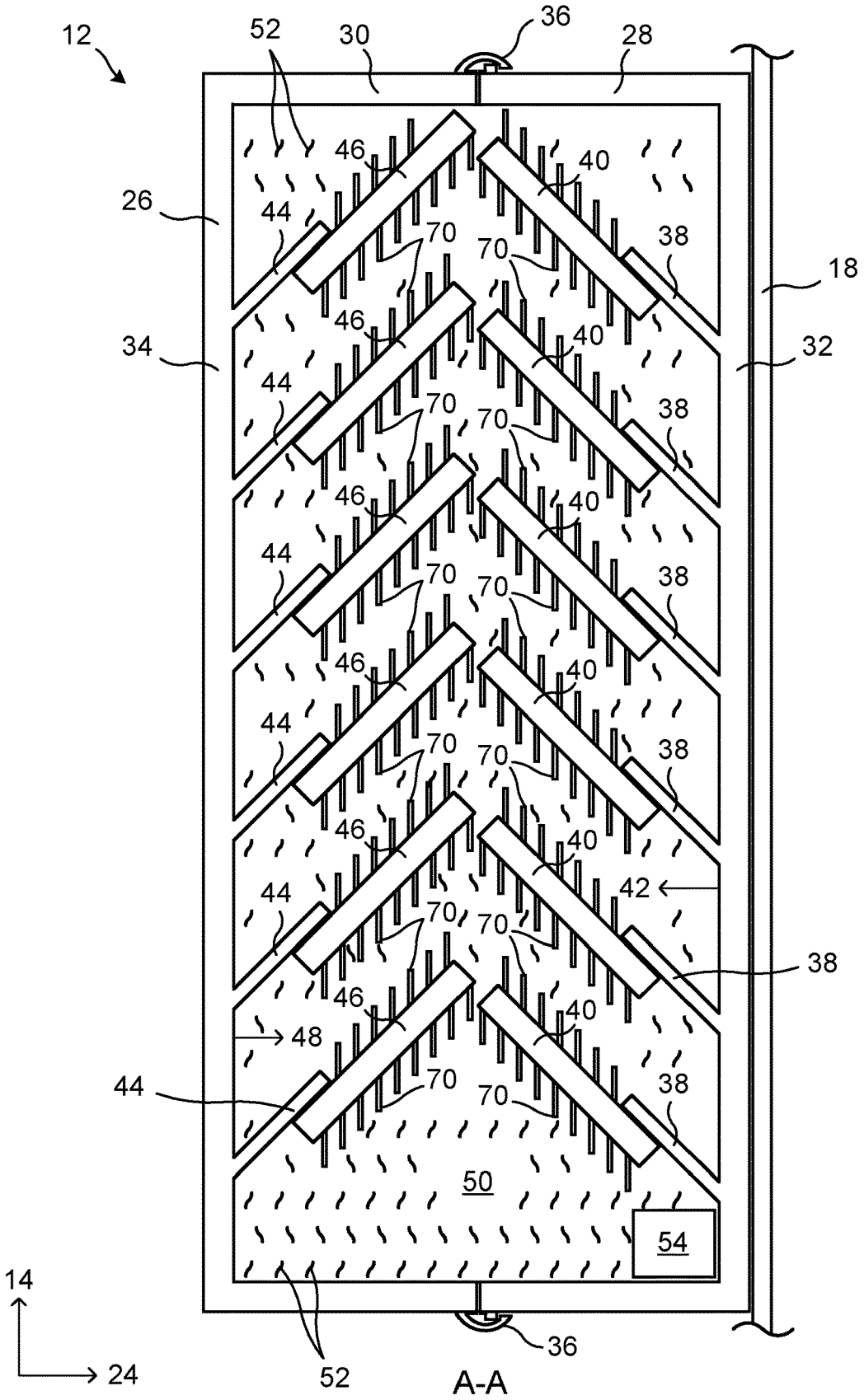
FIG. 7: schematically represents cross-sectional side view of a further drill protection device.

FIG. 7 schematically represents a cross-sectional side view of a further drill protection device 12. The drill protection device 12 in FIG. 7 differs from the drill protection device 12 in FIG. 3 in that the drill protection device 12 in FIG. 7 comprises a plurality of barbs 70 attached to the first plate members 40 and to the second plate members 46. The fiber bundle 66 stuck on the drill bit 56 (see FIG. 5) tend to tangle up with the barbs 70. Due to the barbs 70, it is even more difficult to drill through the drill protection device 12 or to retract the drill bit 56 out from the drill protection device 12. Thus, a drill protection device 12 comprising barbs 70 arranged on the first plate members 40 and/or the second plate members 46 even more efficiently opposes drilling.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

What is claimed is:

1. A drill protection device for an access member, the drill protection device comprising:

an enclosure defining an interior volume and comprising a first side wall;

at least one first plate member arranged within the interior volume, the at least one first plate member being flexibly connected to the first side wall and angled with respect to the first side wall; and fibers arranged within the interior volume such that the fibers fill substantially an entirety of the interior volume.

2. The drill protection device according to claim 1, wherein the fibers are at least partially produced from, or at least partially comprise, bamboo, Dyneema® fiber, glass, hemp, high-strength polyester, polyamides, aramids, polyethylene, linear polyethylene, Kevlar® fiber, polyamide, or Spectra® fiber.

3. The drill protection device according to claim 1, wherein the at least one first plate member is angled 35 degrees to 85 degrees with respect to a normal of the first side wall.

4. The drill protection device according to claim 1, further comprising a first flange associated with each of the at least one first plate member, wherein the first flange is provided on the first side wall and configured to flexibly support an associated first plate member of the at least one first plate member.

5. The drill protection device according to claim 1, wherein the enclosure is made of sheet metal.

6. The drill protection device according to claim 1, wherein the enclosure has a substantially flat appearance.

7. The drill protection device according to claim 1, wherein each plate member is made of sheet metal.

8. The drill protection device according to claim 1, further comprising an accelerometer configured to detect vibrations in the drill protection device.

9. The drill protection device according to claim 1, wherein the enclosure comprises a second side wall opposite to the first side wall, and wherein the drill protection device further comprises at least one second plate member arranged within the interior volume, the at least one second plate member being flexibly connected to the second side wall and angled with respect to the second side wall.

10. The drill protection device according to claim 9, wherein the at least one second plate member is angled 35 degrees to 85 degrees with respect to a normal of the second side wall.

11. The drill protection device according to claim 9, further comprising a second flange associated with each of the at least one second plate member, wherein the second flange is provided on the second side wall and configured to flexibly support an associated second plate member of the at least one second plate member.

12. A drill protection assembly for an access member, the drill protection assembly comprising:

at least two drill protection devices, each drill protection device comprising:

an enclosure defining an interior volume and comprising a first side wall;

at least one first plate member arranged within the interior volume, the at least one first plate member being flexibly connected to the first side wall and angled with respect to the first side wall; and fibers arranged within the interior volume such that the fibers fill substantially an entirety of the interior volume.

13. The drill protection assembly according to claim 12, wherein the at least two drill protection devices are arranged in a stack.

14. An access member, comprising:

a drill protection device, the drill protection device comprising:

an enclosure defining an interior volume and comprising a first side wall;

at least one first plate member arranged within the interior volume, the at least one first plate member being flexibly connected to the first side wall and angled with respect to the first side wall; and fibers arranged within the interior volume such that the fibers fill substantially an entirety of the interior volume.

* * * * *